United States Patent [19]

Schleffendorf

[11] Patent Number: 4,632,388

[45] Date of Patent: Dec. 30, 1986

[54] EXERCISING SYSTEM WITH CABLE, PULLEYS AND WEIGHTS

[76] Inventor: John J. Schleffendorf, 2312 Crescent Ave., Waukegan, Ill. 60085

[21] Appl. No.: 691,010

[22] Filed: Jan. 14, 1985

[51] Int. Cl.[4] ..... A63B 21/06

[52] U.S. Cl. ..... 272/118; 272/117

[58] Field of Search ..... 272/117, 118, 134, 93, 272/116, DIG. 4

[56] References Cited

U.S. PATENT DOCUMENTS

| | | | |
|---|---|---|---|
| 745,154 | 11/1903 | Calada . | |
| 3,858,873 | 1/1975 | Jones . | |
| 4,154,441 | 5/1979 | Gajda . | |
| 4,296,924 | 10/1981 | Anzaldua et al. . | |
| 4,402,504 | 9/1983 | Christian | 272/118 |
| 4,515,363 | 5/1985 | Schleffendorf . | |
| 4,549,733 | 10/1985 | Salyer | 272/134 X |

FOREIGN PATENT DOCUMENTS

| | | | |
|---|---|---|---|
| 0060798 | 9/1982 | European Pat. Off. | 272/118 |
| 3205581 | 8/1983 | Fed. Rep. of Germany | 272/117 |
| 7609655 | 3/1978 | Netherlands | 272/117 |

OTHER PUBLICATIONS

Fitness Catalog-Paramount Health Equipment Corp., published before Aug. 10, 1981 (date unknown).

*Primary Examiner*—Richard J. Apley
*Assistant Examiner*—Robert W. Bahr
*Attorney, Agent, or Firm*—Hill, Van Santen, Steadman & Simpson

[57] ABSTRACT

An exercise device comprises weights, cables and pulleys, which allows for the exercising of a wide range of muscle groups by the rearrangement of the cables on a single weight machine. A cable carrying the weights passes over a first pulley and has a second pulley attached to its free end. A second cable passes through the second pulley and is anchored at one end and has a handle on its free end. When the handle is pulled during an exercise, the second pulley and first cable are moved, thus lifting the weights.

3 Claims, 8 Drawing Figures

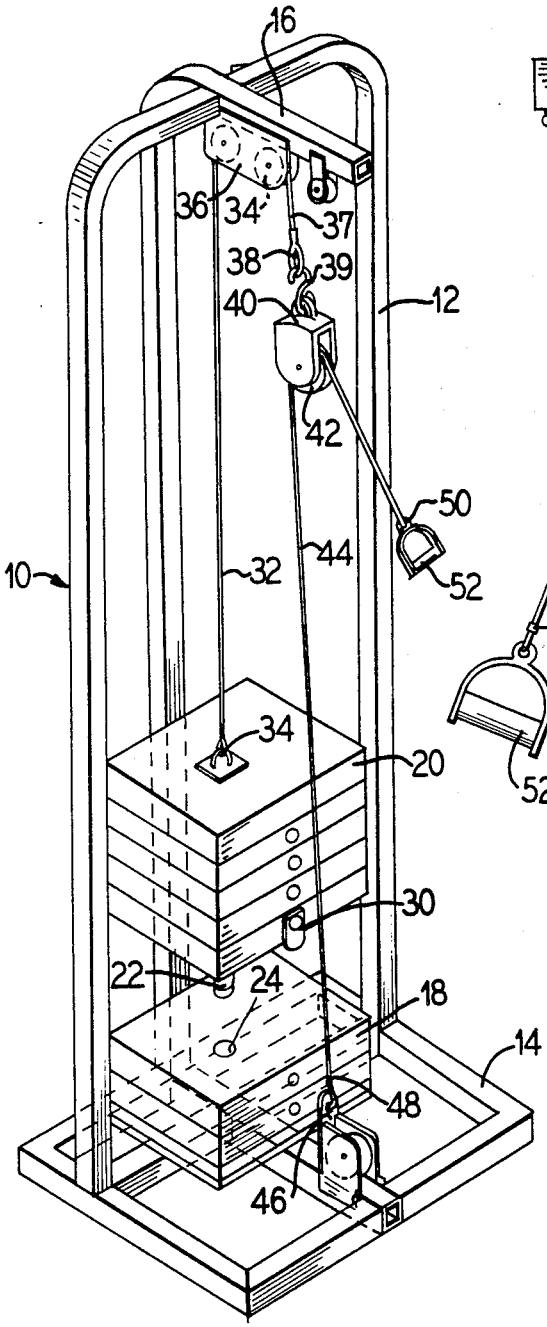
FIG. 1
FIG. 2
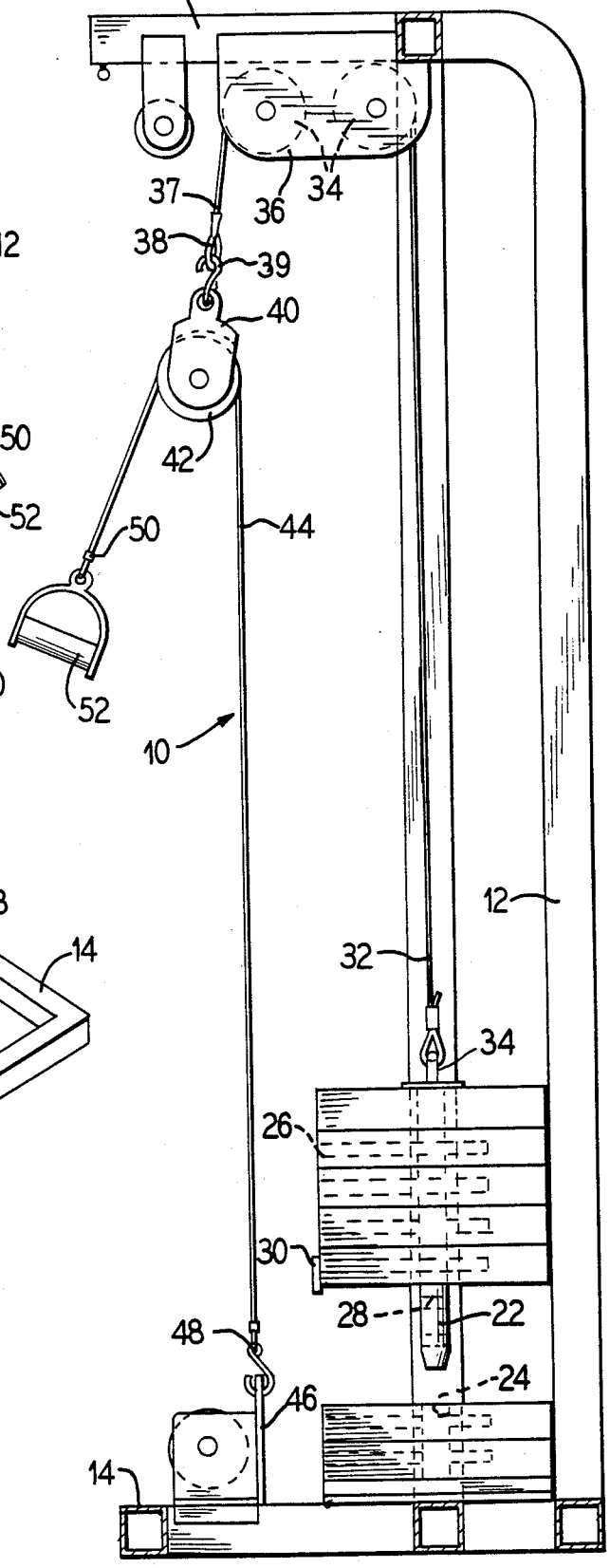

EXERCISING SYSTEM WITH CABLE, PULLEYS AND WEIGHTS

BACKGROUND OF THE INVENTION

1. Field of the Invention

The present invention relates to physical exercise apparatus for use in developing human muscles.

2. Description of the Prior Art

Exercise equipment used to develop human muscles is well known. Among the most widely used of such equipment are machines using weights suspended by cables with the cables passing over one or more pulleys. An exercise handle connected to the free end of the cable provides a means by which a trainee may raise and lower the suspended weights and thus perform a number of prescribed exercises.

However, most prior art exercise machines of this type are equipped with fixed pulleys and are thus capable of providing uniform resistance—and muscle loading—only in linear exercise movements. When rotary exercises are performed on such devices a mechanical advantage is gained over the machine, in certain ranges of exercise movements, with a resulting undesireable decrease in the resistance loads. In all efficient exercise devices, the resistance curve provided should closely match the strength curve of the muscle being trained. However, in regard to rotary movements performed on standard cable, weight stack, fixed pulley devices, this effect cannot be uniformly provided.

Further, the prior exercise devices which utilize weights and fixed pulleys are generally deficient in that they do not provide the means by which the angle of pull is continuously varied throughout exercise movements requiring this effect. Thus the correct angle between the exercise cable and exercising limb is maintained only momentarily in the full range of an exercise movement. Therefore with prior cable training equipment, maximum muscle stimulation is not maintained throughout the full range of an exercise movement.

U.S. Pat. No. 4,154,441 discloses a device for varying the angle of the exercise handle as pulled during utilization of the exercise device. However, the device disclosed has a number of drawbacks. First, several different devices are required to adequately exercise all of the various muscle groups of the human body. Second, several variations on the device disclosed in that patent must be built to oversized dimensions in order to function properly, and thus are difficult to locate in rooms of average dimensions. Third, the device disclosed in this patent tends to unreasonably distort the resistance curve provided by the associated weight stack or other such resistance means. In many exercises performed with the cable/pulley configuration described in this patent, the uniform resistance load provided by lifting a weight vertically, is actually increased up to 60% from the beginning to end range of the exercise movement.

SUMMARY OF THE INVENTION

The present invention provides an exercise system in which a single weight stack machine, with appropriate attachments, can be used to exercise and develop a wide range of human muscles.

A single weight stack is used which comprises a plurality of individual weight plates selectively attachable to a cable which extends upwardly over a first pair of pulleys. An end of the cable has a pulley attached to it and the handle for lifting the weights is attached to a separate cable which passes over the pulley on the end of the first cable. The second cable is attached at its end opposite the handle at various locations depending on the muscle group being exercised. The first cable is directed over a selected configuration of pulleys again depending on the muscle group being exercised.

The single weight stack machine may be combined with a duplicate machine to allow a user to exercise two sets of identical muscles simultaneously, that is the identical muscles of the right side and left side of the body.

Since the pulley carried on the end of the first cable travels either downward, upward, or across (depending on machine configuration) in direct proportion to the length of travel of the exercise handle, the angle of resistance is constantly altered. This lessens the ability of the user to gain a mechanical advantage over the exercise device (which reduces training effectiveness), and it helps to transmit the undistorted resistance curve of the moving weight stack to the limbs or trunk of the exercising trainee. Thus it is possible to perform rotary exercise movements, with approximately correct resistance curves, with what is essentially a linear cable system.

BRIEF DESCRIPTION OF THE DRAWINGS

FIG. 1 is a perspective view of an exercise device embodying the principles of the present invention;

FIG. 2 is a side elevational view of the device shown in FIG. 1;

DESCRIPTION OF THE PREFERRED EMBODIMENTS

Figure 3:
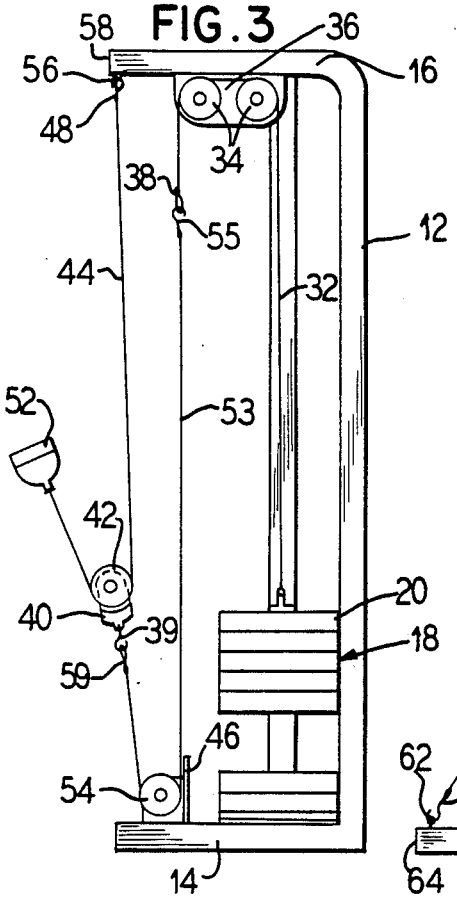
FIG. 3 is a side schematic view of the device shown in FIG. 1 in an alternative configuration.

In FIGS. 1 and 2 there is shown an exercise device generally at 10 which comprises a vertical frame 12 secured to a base 14 and having a top horizontal frame arm 16. Supported on the base 14 is a weight stack 18 comprised of individual weight plates 20. A weight post 22 extends downwardly through the weight stack 18 through a series of aligned apertures 24. Each of the individual weight plates 20 has a horizontal bore 26 therein which intersects the aligned apertures 24. The weight post 22 has a series of spaced horizontal apertures 28 therethrough which align with the bore 26 in the weight plates when the weight post 22 is fully inserted into the weight stack 18. A removable pin member 30 is provided which can be inserted into one of the bores 26 and through the associated aperture 28 in the weight post 22 such that the weight plate into which the pin is inserted as well as all weight plates above the selected plate will be carried on the weight post 22 when lifted.

To assist in the lifting of the weight post 22 and associated individual weight plates 20, there is provided a first cable 32 which is securely attached to a top end 34 of the weight post 22. The cable 32 extends vertically upward toward the horizontal arm 16 where it passes over and is permanently captured by a pair of pulleys 34 mounted in brackets 36 depending from the arm 16. A second end 37 of the cable 32 has a connector ring 38 attached thereto which is secured to a hook 39 carried on a pulley housing 40. A pulley 42 is rotatably carried in the housing 40. A second cable 44 may be secured to a bracket 46 attached to the base 14 at a first end by a removable hook 48. A second end 50 of the cable is secured to a grasping means 52 such as a handle. The cable 44 is wrapped over and is permanently captured by the pulley 42 intermediate the two ends 48, 50 of the cable.

In operation, after the user has inserted the pin 30 into the appropriate weight plate 20, the user would grasp the handle 52 and pull downwardly or outwardly on the handle thus causing the pulley 42 to move downwardly thereby lifting the selected portion of the weight stack 18. As the handle 52 is moved through an arc during the exercise movement, the angle of pull is varied which is accomodated by the connection to the pulley 42. The pulley 42, being attached to the end of the cable 32 is free to move relative to the weight stack 18 and the frame 12. The pulleys 34 act as a pivot for the cable 32 permitting the pulley 42 to make the relative movement thereby accomodating the varying angle of pull in an effective and efficient manner.

The configuration of the device shown in FIG. 2 is useful in performing the following exercises which benefit the listed muscle groups:

| Exercise | Muscle Primarily Effected |
|---|---|
| Standing Pec Crossover | Pectoralis Major |
| Tricep Extension and Kickback | Tricep, Posterior Deltoid |
| Seating Rowing | Latisimus Dorsi, Biceps |
| Standing Hip Hyperextension | Gluteus Maximus |

FIG. 3 shows an alternative configuration of the cables to allow for an upward and outward exercising movement. The same basic unit can be utilized in this configuration in which a different set of muscles is exercised. In this configuration, a third cable 53 passes under a lower pulley member 54 carried in the bracket 46 which is mounted to the bottom frame member 14. The third cable has a hook 55 at a first end for attaching to the ring 38 on the first cable. The second cable 44 is secured at the second end 48 to a retaining means 56 such as an eye bolt mounted near a front end 58 of the top horizontal frame member 16. The second cable 44 is permanently looped around the pulley 42 which is attached by the hook 39 to a ring 59 on a second end of the third cable 53. Thus, the fixed length second cable 44 can be used in all of the configurations shown in the drawings by attaching the hook 39 to the ring 59 on the third cable 53 or the ring 38 on the first cable 32. This adds versatility to the device without requiring multiple machines for multiple exercise movements.

Thus, when a user pulls upwardly or outwardly on the handle 52, it causes the pulley 42 to be moved upwardly and outwardly thereby lifting the selected number of weight plates 20 of the weight stack 18. Again, variations in the angle of pull are accomodated in that this exercise device uses a linear means (moving pulley and cable) to provide a relatively constant movement force resistance for rotary exercise movements.

The configuration of the device shown in FIG. 3 is useful in performing the following exercises which benefit the listed muscle groups:

| Exercise | Muscle Primarily Effected |
|---|---|
| Lying High Pulls (upright rowing) | Deltoids, Tapezius |
| Bench Bicep Curls | Biceps |
| Lying Pec Crossovers (Flyes) | Pectoralis major |
| Lying Straight Arm Pullover | Tricep, Pectoralis major |
| Standing Back Hyperextensions | Spinal Erectors |

Figure 4:
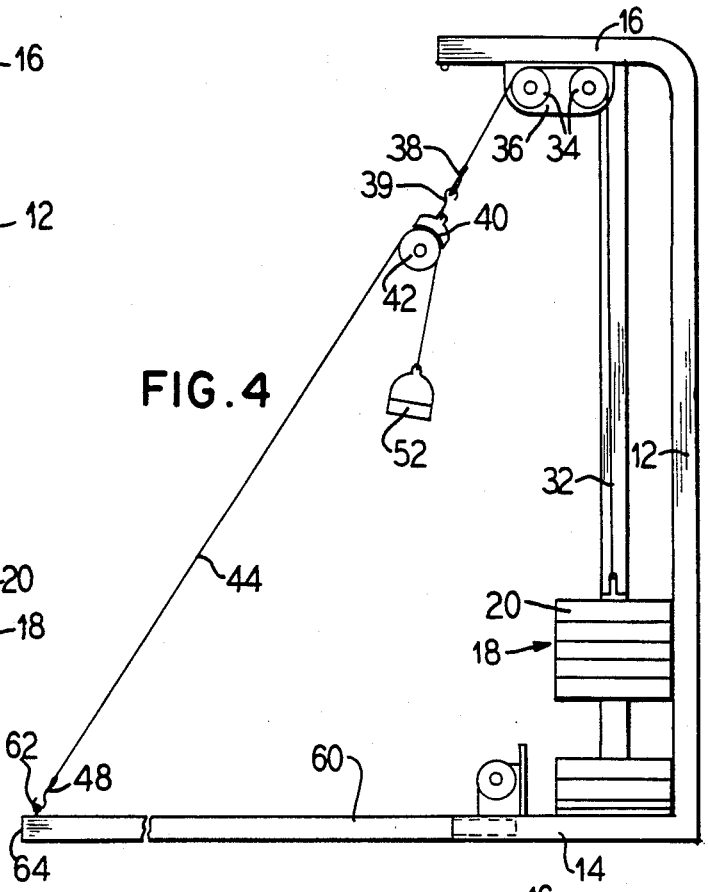
FIG. 4 is a side schematic view of the device shown in FIG. 1 with a lower mounting attachment.

FIG. 4 shows another configuration of the cables to provide an angularly downwardly exercising movement while still utilizing the same basic structure of the exercise device. In this configuration, an extension member 60 of the base 14 is utilized which extends outwardly from the front of the base. A retaining member 62 such as an eye bolt is provided at a distant end 64 of the extension 60. The second cable 44 is attached by the hook 48 to the eye bolt 62 and is wrapped around the pulley 42 as described above. The first cable 32 extends upwardly from the weight stack 18 over the pulleys 34 and the hook 39 on the pulley housing 40 attaches to the ring 38 on the end of cable 32. When the user pulls downwardly, the pulley 42 is pulled downwardly thus lifting the selected weight plates 20 of the weight stack 18.

Figure 5:
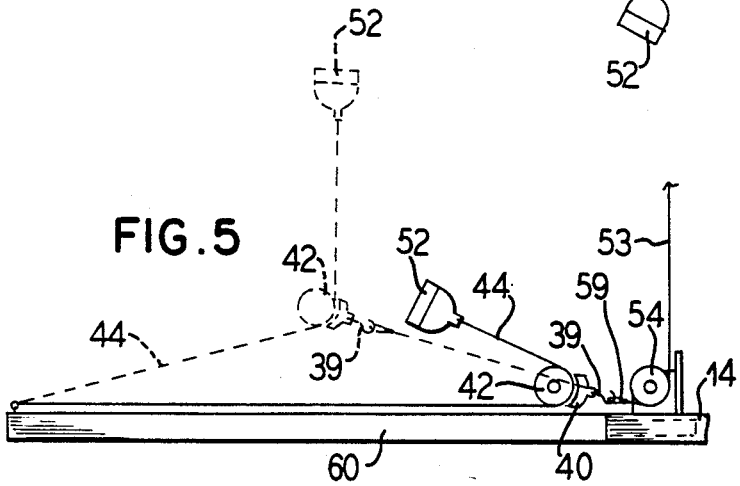
FIG. 5 is a partial schematic illustration showing movement of the grasping means and associated pulley.

FIG. 5 shows an alternate configuration of the cables for a lifting type exercise in which the third cable 53 is again utilized and is attached by the ring 59 to the hook 39 on the pulley housing 40. The second cable 44 is attached as shown in FIG. 4. As the handle 52 is pulled outwardly and upwardly, the pulley 42 moves outwardly and upwardly thus lifting selected weight plates 20 of the weight stack 18.

The configuration of the device shown in FIG. 5 is useful in performing the following exercises which benefit the listed muscle groups:

| Exercise | Muscle Primarily Effected |
|---|---|
| Lateral Raise | Deltoids |
| Bent Over Lateral Raise | Posterior Deltoids, Trapezius |
| Standing Hip Flexion | Hip Flexors, Quadriceps |
| Front Shoulder Raise | Anterior Deltoid |

Figure 6:
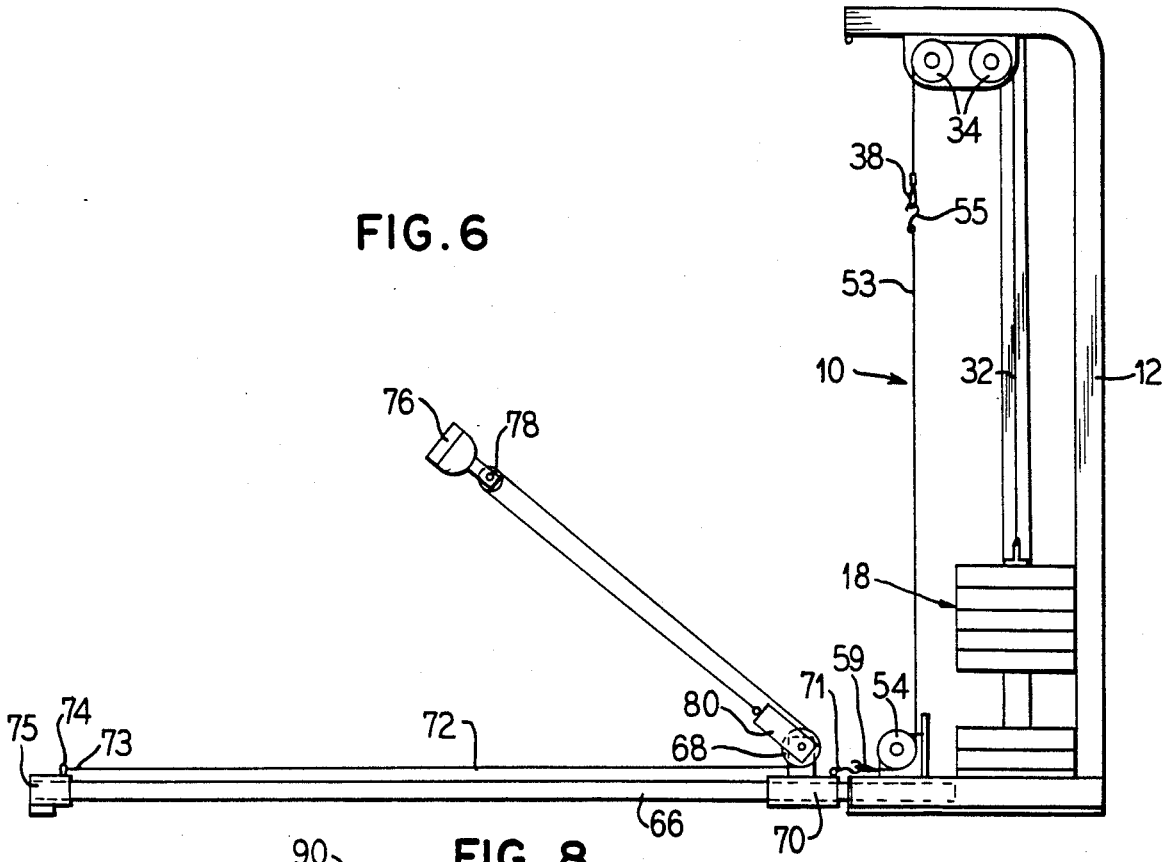
FIG. 6 is a side schematic view of an alternative mounting means.

FIG. 6 shows the use of an alternate base extension member 66 which has a pulley 68 mounted on a slide 70 which can travel the length of the extension member 66. The first cable 32 passes over the upper pulleys 34 and attaches to the third cable 53 which passes around the lower pulley 54 and is attached by a hook 71 to the slide member 70. A fourth cable 72 attaches at an end 73 to a retaining means 74 at a distant end 75 of the extension member 66. The second cable 72 extends along the length of the extension member 66 and passes around the pulley 68 up toward a modified handle 76. The handle 76 has a pulley 78 attached thereto which the cable 72 passes around and then continues back down toward the pulley 68 where it is attached to a bracket 80 which carries the pulley 68. Such a cable arrangement provides an increased length of travel of pulley 68 on the extension slide bar 66. This extended length of travel is an improvement over prior exercise devices such as that disclosed in U.S. Pat. No. 4,154,441.

Figure 7:
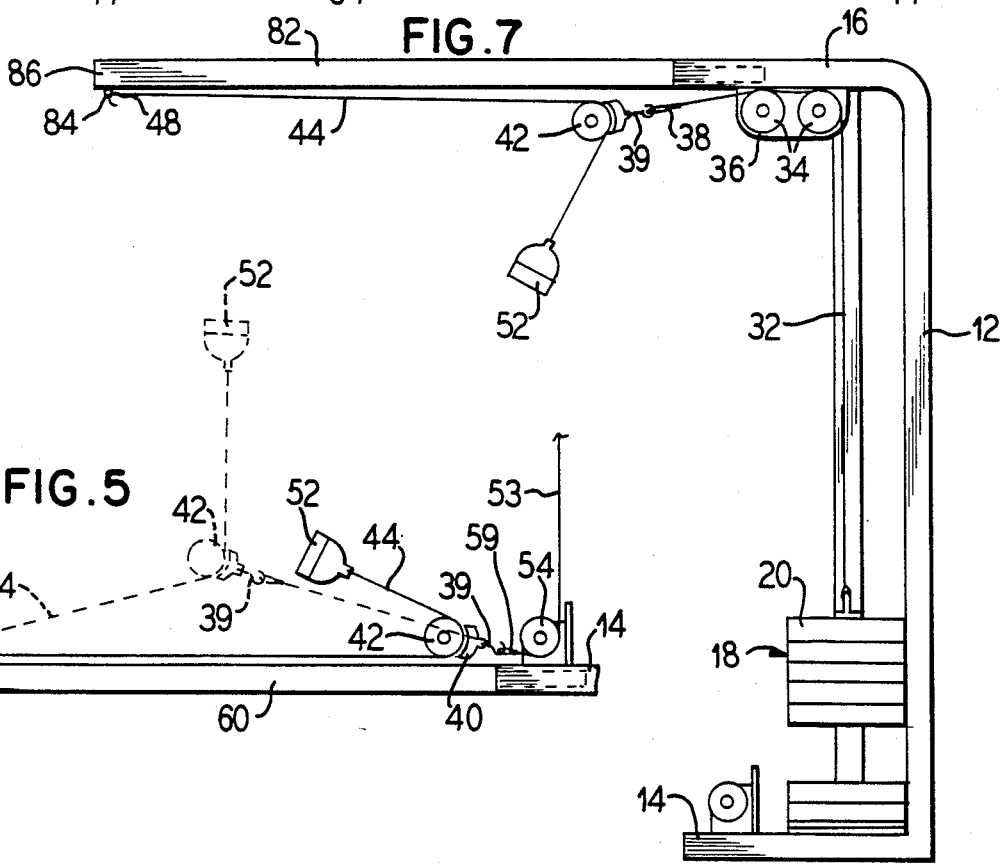
FIG. 7 is a side schematic view of the device shown in FIG. 1 with a top mounting attachment.

FIG. 7 shows an alternate configuration of the cables to provide an angularly downward exercising movement. In this configuration, a top extension member 82 extends outwardly from the upper frame member 16 and it has a retaining means 84 at a distant end 86. The first cable 32 is arranged similarly to that described for configurations in FIGS. 1, 2 and 4 and the second cable 44 is arranged such that the free end 48 is secured to the retaining means 84 on the upper extension member 82 from where it extends and passes around pulley 42 to the handle 52. Thus, when the user pulls downwardly in an angular direction, the selected weight plates 20 of the weight stack 18 are lifted.

The configuration of the device shown in FIG. 7 is useful in performing the following exercise which benefit the listed muscle group.

| Exercise | Muscle Primarily Effected |
|---|---|
| Lateral Shoulder Flexion | Latisimus Dorsi |

Figure 8:
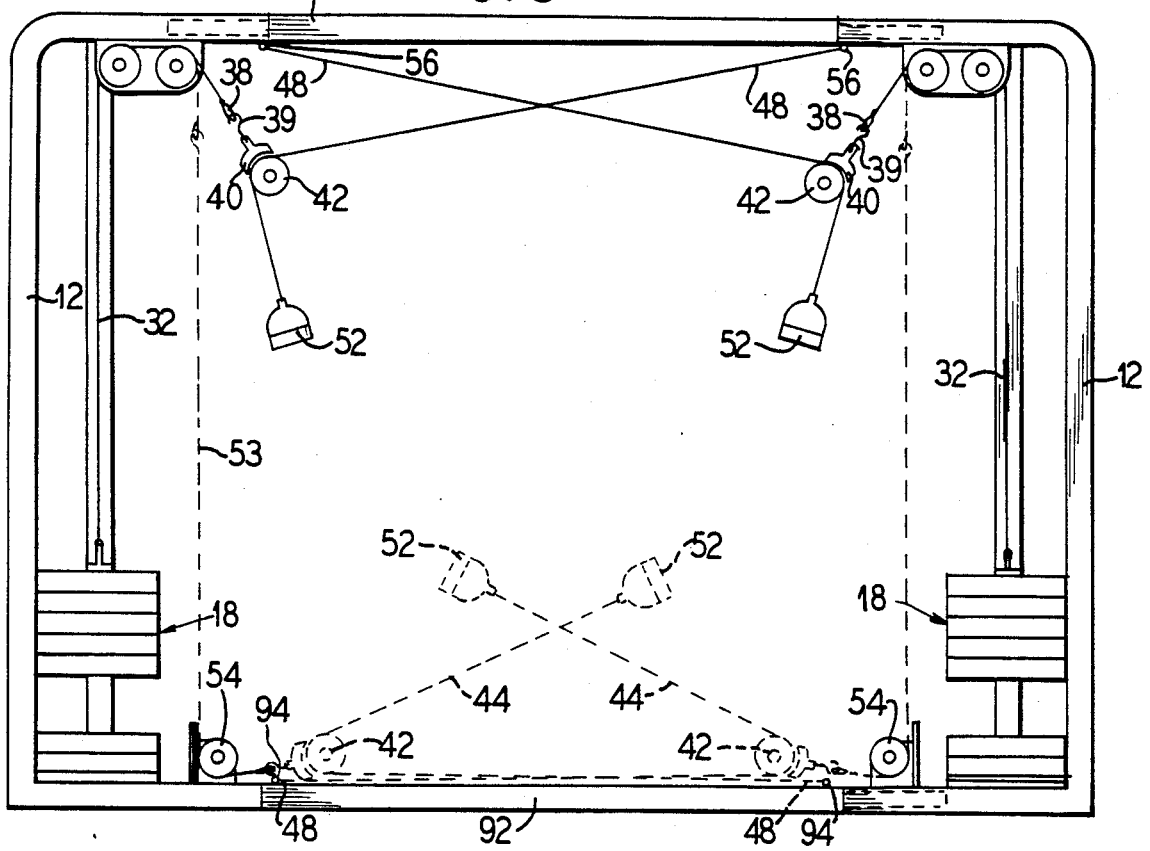
FIG. 8 is a side schematic illustration of two devices similar to that shown in FIG. 1 combined for dual exercising.

FIG. 8 shows a combination device in which two basic units 10 are connected together by an upper extension member 90 and a lower extension member 92. In such a combination, both the right set of muscles and corresponding left set of muscles can be exercised simultaneously. For example, shown in full lines is a cable configuration similar to that shown in FIG. 7 for angularly downwardly exercising movement. In this configuration, the first cables 32, 32 of each basic device are arranged similarly to that described with respect to FIGS. 1, 2, 4 and 7 and the second cables 44, 44 are arranged so that the free ends 48, 48 are attached to the retaining bolts 56, 56 of the basic device 10 opposite the device with which the pulleys 42, 42 over which they pass are associated. The attachment rings 56, 56 are spaced 2 inches apart on opposite bottom corners of extension member 90. This allows cables 44, 44 to pass each other without becoming entangled.

Shown in phantom is an alternate configuration of the cables in which the third cables 53, 53 are arranged similarly to that described with respect to the configurations of FIGS. 3 and 5 above, passing under lower pulleys 54, 54. The second cables 44, 44 are secured at the free ends 48, 48 to retaining means 94, 94 provided at either end of the lower extension member 92. Again, the ends 48, 48 are secured at a side opposite that associated with the pulleys 42, 42 around which the second cables 44, 44 pass thus providing a cross-type exercise configuration.

To obtain the greatest exercising benefits, the cable configuration should provide *no* increase in resistance, but rather transmit the resistance curve of the weight stack uniformly. The device disclosed in U.S. Pat. No. 4,154,441, FIG. 3 fails miserably to do this in that it produces a 60% increase in resistance from beginning to end during certain exercise movements. The configuration embodying the principles of the present invention shown in FIGS. 1 through 5 and 7 and 8 greatly improves the exercising benefits in that it provides at most only an 18% increase in resistance with the same exercise movements. While 18% is still more than is desired, it is a large improvement over available devices.

Thus, it is seen that the present invention provides for a single basic weight lifting unit which can be used to exercise a wide range of muscle groups (even more than have been listed as examples) by slightly changing the cable configurations and attachment points. The exercise device has the advantage that the angle of pull on the handle can change with the directional change of the force exerted by the user to maximize the efficiency and benefit of the exercising machine.

As is apparent from the foregoing specification, the invention is susceptible of being embodied with various alterations and modifications which may differ particularly from those that have been described in the preceding specification and description. It should be understood that I wish to embody within the scope of the patent warranted hereon all such modifications as reasonably and properly come within the scope of my contribution to the art.

I claim as my invention:

1. An exercise apparatus for muscle development comprising:

(a) a selectively variable vertically movable weight;

(b) first cable means attached at a first end to said weight centrally thereof for lifting said weight;

(c) first pulley means mounted solely by a first selectably detachable connection directly to a second end of said first cable means;

(d) a second pulley means supported by a fixed frame and receiving said first cable;

(e) a second cable means wrapped around said first pulley means;

(f) one end of said cable means terminating in a grasping means;

(g) said grasping means being graspable by a user to operate on said second cable and said first pulley means, and the other end of said second cable having a second selectably detechable connection with a fixed anchor means;

(h) said weight means being free to move vertically relatively to said frame when a user's force is applied to said grasping means; and (i) the axis of said first pulley being free to be moved in a direction which has components that are simultaneously parallel to and transverse to the direction of weight movement; whereby the application of a user's non-vertical force to said grasping means causes said first pulley means to move in a direction having vertical and horizontal components relative to said frame as said first pulley means moves about said second pulley means.

2. A device according to claim 1, said frame further including removable top and bottom horizontal extensions with additional anchor means thereon for said second connection.

3. A device according to claim 1, including a plurality of selectably useable anchor means on said frame for said second selectably detactable connection.

* * * * *